US005475968A

United States Patent [19]

Linder

[11] Patent Number: 5,475,968

[45] Date of Patent: Dec. 19, 1995

[54] DEVICE FOR COMBINING PRINTED PRODUCTS THAT ARE SUPPLIED TO A FOLDED ENVELOPE

[75] Inventor: Heinz Linder, Zofingen, Switzerland

[73] Assignee: Grapha-Holding AG, Hergiswil, Switzerland

[21] Appl. No.: 118,403

[22] Filed: Sep. 9, 1993

[30] Foreign Application Priority Data

Sep. 14, 1992 [CH] Switzerland ..... 02893/92

[51] Int. Cl.[6] ..... B65B 35/50; B65B 3/04; B65B 43/50; B65B 43/44

[52] U.S. Cl. ..... 53/531; 53/237; 53/253; 53/569; 53/574

[58] Field of Search ..... 53/237, 253, 284.3, 53/381.5, 531, 569, 570, 571, 574; 270/55, 57

[56] References Cited

U.S. PATENT DOCUMENTS

| | | | |
|---|---|---|---|
| 3,381,447 | 5/1968 | Ash et al. | 53/284.3 |
| 4,010,598 | 3/1977 | Mueller | 53/206 |
| 4,046,367 | 9/1977 | Merker et al. | 270/55 |
| 4,124,203 | 11/1978 | Müller | 270/55 |
| 4,614,079 | 9/1986 | Ida et al. | 53/579 |
| 4,709,910 | 12/1987 | Honegger | 270/55 |
| 4,813,662 | 3/1989 | Merwarth et al. | 271/315 |
| 5,269,504 | 12/1993 | Backman | 270/57 |

FOREIGN PATENT DOCUMENTS

| | | |
|---|---|---|
| 0241634 | 10/1987 | European Pat. Off. . |
| 0247315 | 12/1987 | European Pat. Off. . |
| 0344102 | 11/1989 | European Pat. Off. . |
| 2247408 | 5/1975 | France . |

*Primary Examiner*—John Sipos
*Assistant Examiner*—Rodney A. Butler
*Attorney, Agent, or Firm*—Spencer, Frank & Schneider

[57] ABSTRACT

A device is provided to combine printed products that are supplied to a folded envelope. A rotating conveying member is equipped with receiving pockets that are distributed over its circumference and can be closed and opened. The receiving pockets have an associated charging station for the envelopes and a supplying station for the enclosures on the opposite side of the conveying member as well as a subsequently connected removal station, with the charging station and the supplying station being connected by means of an undercut conveying region of the conveying member.

18 Claims, 2 Drawing Sheets

DEVICE FOR COMBINING PRINTED PRODUCTS THAT ARE SUPPLIED TO A FOLDED ENVELOPE

CROSS REFERENCE TO RELATED APPLICATION

This application claims the priority of application Ser. No. 02 893/92-8, filed Sep. 14, 1992, in Switzerland, the subject matter of which is incorporated herein by reference.

BACKGROUND OF THE INVENTION

The present invention relates to a device for combining printed products supplied to a folded envelope or cover, the device comprising a sector-like rotating conveying member equipped with receiving pockets that can be controlled into a closed and an open position, with a charging station that supplies the envelope fold-first and at least one subsequently connected supplying station for filling the open envelope with the collected printed products as well as a removal station being associated with the circumference of the conveying member.

Prior art devices of the above type include a rotating conveying member equipped with sector-like receiving pockets which receive the printed products, for example, enclosures or the like, that are combined in envelopes in the overshot region of the conveying member and discharges them to a delivery device disposed below a horizontal plane defined by the rotation axis of the conveying member, with the envelopes leaving the conveying member with their open side facing forward to be discharged by means of a conveyor belt.

Such an arrangement of the delivery device has drawbacks because the enclosures or preliminary products inserted into the envelopes or primary products are able to slip out of the latter through the downwardly inclined opening and thus may interfere with further processing by interruptions.

SUMMARY OF THE INVENTION

It is thus an object of the present invention to create a device of the above-mentioned type with which the reliability of the processing of supplied printed products can be improved.

According to the present invention this is accomplished in that the undershot conveying region of the conveying member, which connects the charging station and the supplying station that lie approximately opposite one another at the conveying member, is constructed so as to produce a conveying effect and the removal station is disposed above a horizontal plane defined by the rotation axis of the conveying member. In this way, the envelopes can be gripped from the top at their open sides, the escape of enclosures placed in the envelopes can be prevented, thus ensuring further processing, and the envelopes can be removed from the receiving pockets.

In one embodiment of the present invention, a drum-shaped conveying member has been found to be advantageous because of its great stability and the easy manner of arranging receiving pockets.

In the configuration of the removal station, it has been found to be particularly advisable to provide a clocked transporting member that is disposed adjacent to the conveying member and that is driven in the same direction as the latter and enters into the open receiving pockets by means of controlled gripping tongs in order to remove the printed products at the open side of the receiving pockets.

Preferably at least the leading wall of a receiving pocket is controlled in such a way that its forward movement is delayed at the charging station for the envelope so that the transition from this station to the receiving pockets is essentially smooth.

For the same reason, the trailing walls of the receiving pockets which guide the enclosures into the receiving pockets may be configured so that they are delayed with respect to their forward movement at the supplying station for the enclosures.

The receiving pockets are preferably equipped with holding devices which, after the supplied envelopes leave the charging station, hold them in position during their travel, particularly in the undershot region of the conveying member.

Moreover, both or one of the walls of the receiving pockets may be controlled to be adjustable in such a manner that the receiving pockets are closed downstream of the charging station.

As soon as the receiving pockets are disposed above a plane defined by the rotation axis of the conveying member, they can be further charged with enclosures or printed products. For this purpose the envelopes are advantageously placed and held in an opened position.

To accomplish this, the upper face of an envelope is preferably supplied, for example, by means of an actuatable clamp, with the upper or leading receiving pocket wall, which is driven to open.

In preparation for the removal of the complete set of products from the receiving pockets, the latter are advisably provided with a device that aligns or stacks the incoming printed products including the envelope or main product, preferably places the printed products against the trailing wall of the receiving pockets where, in a subsequent step, they are gripped and removed as a packet by the gripping tongs of the clocked transporting member and are transported away.

In an arrangement suitable for this purpose, the charging station is configured as a sheet feeder for the envelopes or a printed product employed as the main product.

An alternative embodiment of the device according to the invention is provided with a charging station that is preceded by a sheet cutting and folding device that produces the envelopes from a roll of paper.

In a further embodiment the envelope could be provided with a foldable adhesive strip, or fold at its open side so that the supplied enclosures are completely enclosed by folding over the adhesive strip.

Another possibility of combining the enclosures is the use of a thin sheet in that, in order to form a folded envelope, a draw-in device which enters into the receiving pockets of the rotating conveying member at the charging station supplies the receiving pockets with a section of a continuous thin sheet that can be welded together at the open side.

The free edges of these sections may here be welded to one another after the enclosures have been supplied, for example by a closing movement of receiving pockets that are equipped with a welding device.

A suitable device is a draw-in device which can be lifted out of the receiving pockets no later than after they have been filled.

In the further course of this manner of processing, the enclosures that are completely encased by a thin sheet may be ejected as a packet from the receiving pockets onto a communicating conveying device.

BRIEF DESCRIPTION OF THE DRAWINGS

The present invention will now be described for embodiments thereof that are illustrated in the drawing figures in which.

DETAILED DESCRIPTION OF THE PREFERRED EMBODIMENTS

Figure 1:
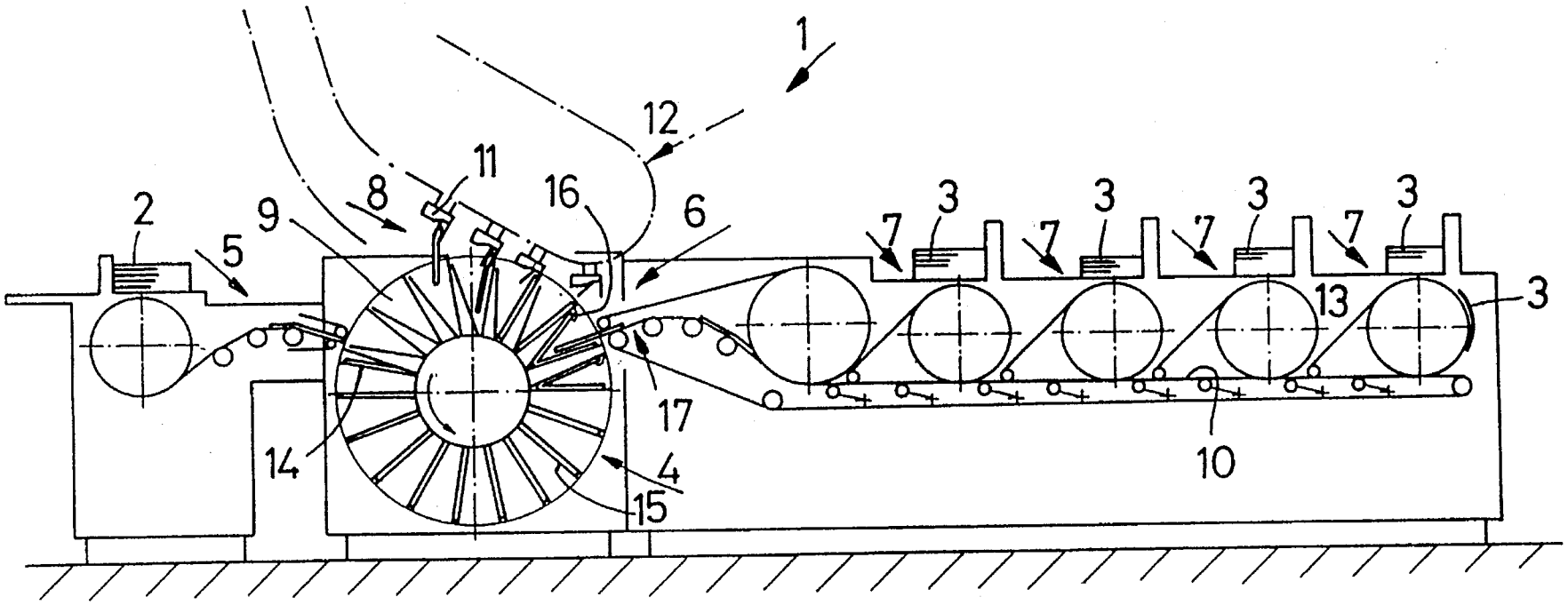
FIG. 1 is a schematic longitudinal sectional view of an embodiment of the present invention.

FIG. 1 depicts a device 1 for combining printed or preliminary products or enclosures in an envelope or cover 2 that is folded at least once or in a main product employed as an envelope, or wrapper, in that one or several such printed products 3 are supplied to an envelope 2 or the like which is in a spread-open state.

For this purpose, the device 1 according to FIG. 1 includes a drum-shaped conveying member 4 which is subdivided into several sectorial receiving pockets 9 that can be put into a closed and an open position and which have an associated charging station 5, for example a sheet feeder, to supply an envelope 2 fold-first and a supplying station 6 connected downstream of the charging station 5 for the printed products 3 collected by several feeders 7 as well as a removal station 8. Charging station 5 feeds the envelope 2 from the side into the conveying member 4 which rotates about an approximately horizontal axis. Then the envelope is transported in a held position through the undershot transporting region of conveying member 4 to a supplying station 6 for the enclosures. Before reaching supplying station 6, the receiving pockets 9 holding envelopes 2 are opened so that the latter can be supplied with the collected enclosures 3.

Then envelope 2 and enclosures 3 are placed next to one another so that the gripping tongs 11 of a clocked transporting member 12 which is disposed above conveying member 4 and is driven in the same direction as conveying member 4 will be able to dip into receiving pockets 9 and remove the filled envelopes. In the present case, the enclosures are collected by means of several series-connected feeders 7 which deposit the enclosures 3 taken from respective stacks onto a yieldingly supported conveyor belt 10. After reaching conveyor belt 10, the removed enclosures 3 are accompanied by a belt 13 that lies on top of them and moves along with them until they reach the next feeder. Each one of the subsequent feeders deposits its enclosure 3 on the enclosure(s) supplied to it from the rear.

In order to be able, on the one hand, to place the enclosures 3 manually onto the feeders 7 and, on the other hand, charge the receiving pockets on a slope, conveyor belt 10, after passing the row of feeders, continues in an ascending section so that the products will subsequently be able to drop into the opening of the receiving pocket 9 to be filled. Of course it is possible to service a receiving pocket that is in the receiving position from the immediate end of the row of feeders, but then the feeders 7 must be arranged at a higher level and must be supplied, if required, by means of transporting members or the like.

In charging station 5, the wall 14 which leads in the conveying direction is controlled to be delayed, as shown in FIG. 1, with respect to its forward movement so that the envelopes 2 in the receiving pocket reach their transporting position after a short time and without influence.

In the same way, the trailing wall 15 may also be constructed to move with a delay at the supplying station 6 for the enclosures 3 or the printed products.

In order for the envelopes 2 or the main products received at charging station 5 not to fall out of receiving pockets 9 in the undershot transporting region of conveying member 4, a holding device (not shown in the drawing) is provided at receiving pockets 9 or, for the same purpose, the receiving pocket may be closed by means of walls 14 and 15 after it has been supplied with an envelope 2 and then opened again upstream of supplying station 6 to receive enclosures 3.

The insertion of enclosures 3 into a receiving pocket 9 holding an envelope 2 that has been opened by a device 16 is effected by means of a delivery device 17 that is connected downstream of the row of feeders.

Then the products that are disposed in the receiving pocket at the end of the charging process are placed against one another or aligned in a stack at the interior face of the trailing wall 15 and are removed or discharged by gripping tongs 11 that enter from the top.

Figure 2:
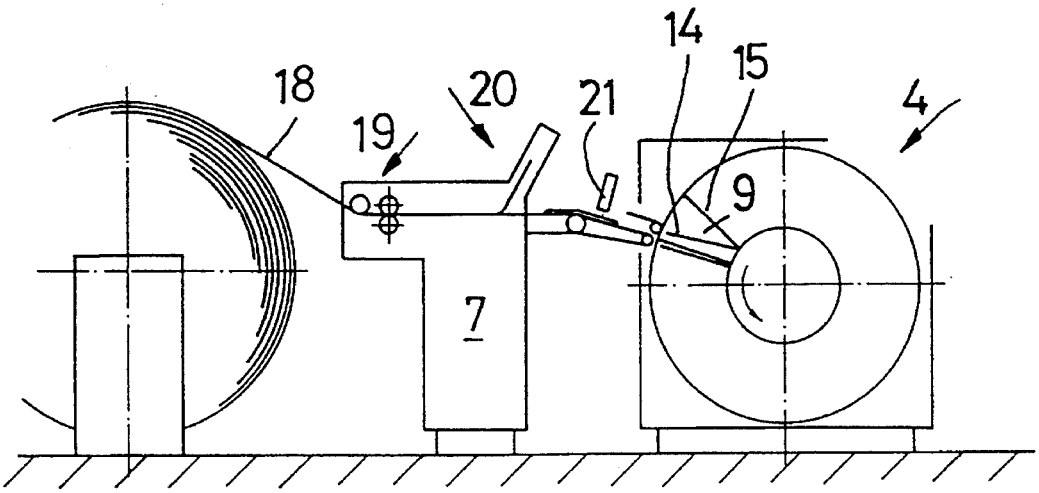
FIG. 2 depicts an alternative charging station in an embodiment of the device according to the invention.

As an alternative, shown in FIG. 2, the envelope 2 intended to receive the enclosures 3, before it moves into conveying member 4, may be produced from a roll of paper 18 by means of a sheet cutter 19 and a folding device 20.

An addressing device 21 disposed between folding device 20 and conveying member 4 takes care that the finished product is ready for shipment.

The envelope 2 could be provided with an adhesive strip or fold which serves to completely enclose the enclosures.

Figure 3:
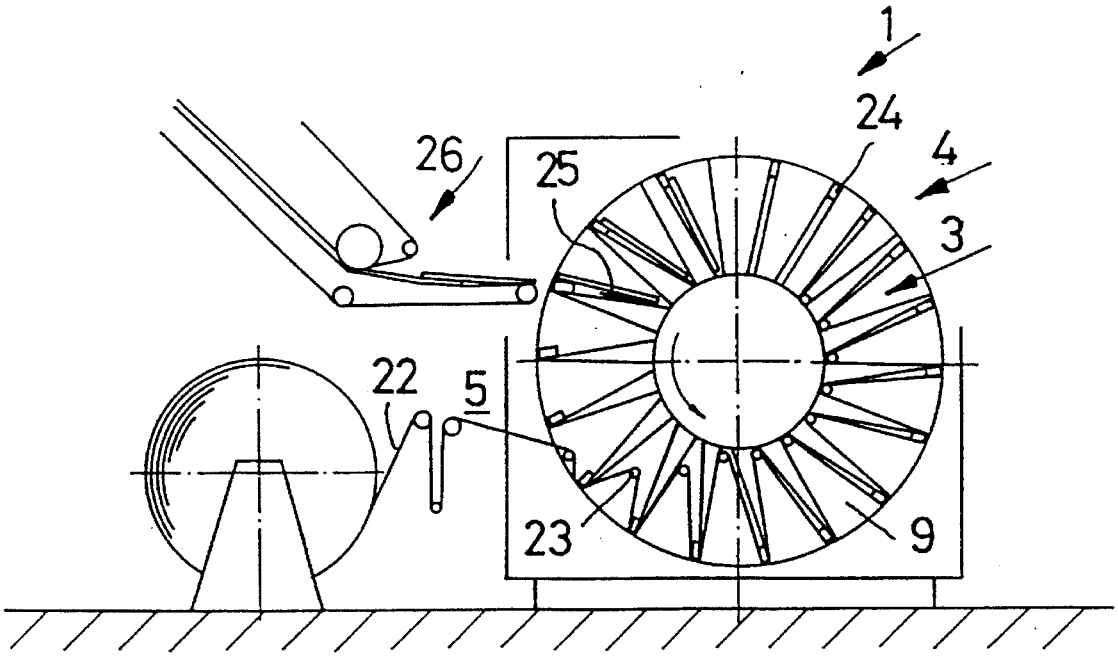
FIG. 3 depicts a further, alternative charging station of an embodiment of the device according to the invention.

Another possibility of combining or wrapping the enclosures 3 is shown in FIG. 3.

In the device 1 partially shown there, the receiving pockets 9 of conveying member 4 in the charging station are initially lined with a continuous thin sheet 22 to then be filled with enclosures 3. The inner lining is effected by a draw-in device 23 which draws the sheet brought into the vicinity of the device from outside into the receiving pockets 9.

Draw-in device 23 remains at the lower end of receiving pocket 9 until the latter is filled with the first enclosure 3. Then the draw-in device is removed from receiving pocket 9 and returned to the supplying position at charging station 5.

At the outer edge of at least one wall 14 or 15 of receiving pockets 9, a welding device 24 is disposed which, by closing receiving pockets 9, welds the thin sheet 22 present along the periphery of conveying member 4 into an envelope that completely surrounds enclosures 3.

Thereafter, receiving pockets 9 are opened above the rotation axis of conveying member 4 and an ejection device 25 shown only schematically transfers the packet-like bound structures holding the printed products from conveying member 4 onto a conveying device 26 on which they are transported away.

It will be understood that the above description of the present invention is susceptible to various modifications, changes and adaptations, and the same are intended to be comprehended within the meaning and range of equivalents of the appended claims.

What is claimed is:

1. In a device for combining printed products supplied to a folded envelope, the device comprising a sector-like rotatable conveying member including receiving pockets that can be controlled into a closed position and an open position, a charging station for supplying the envelope fold-first to a receiving pocket, at least one supplying station for filling the open envelope with printed products, and a removal station for finished products associated with a circumference of said conveying member, the improvement wherein the conveying member is drum-shaped and has an under-shot conveying region, the conveying member is rotatable around an approximately horizontal rotation axis, the receiving pockets are distributed over the circumference of the conveying member, the conveying member is disposed between the charging station and the supplying station which lie approximately opposite one another at the circumference of the conveying member, the conveying member is constructed to produce a conveying effect between the charging station and the supplying station and the removal station is disposed above a horizontal plane defined by the rotation axis of the conveying member.

2. A device as defined in claim 1, wherein the removal station is composed of a clocked transporting member that is disposed adjacent the conveying member, is driven in the same direction as the conveying member and enters into the receiving pockets by means of controlled gripping tongs.

3. A device as defined in claim 1, wherein, at the charging station for envelopes or main products, the receiving pockets include leading walls which when seen in a conveying direction of the conveying member are controlled to be delayed with respect to forward movement of the leading walls.

4. A device as defined in claim 1, wherein, at the supplying station for the printed products, a receiving pocket includes a trailing wall which when seen in a conveying direction of the conveying member is controlled to be delayed with respect to forward movement of the trailing wall.

5. A device as defined in claim 1, wherein the receiving pockets are put into a position in which the envelopes are held when the receiving pockets leave the charging station.

6. A device as defined in claim 1, wherein a trailing wall of each receiving pocket is configured to close the receiving pocket.

7. A device as defined in claim 1, wherein the receiving pockets are configured to open the folded envelopes upstream of the supplying station when seen in a conveying direction of the conveying member.

8. A device as defined in claim 1, wherein the receiving pockets include a device which closes the supplied printed products within said envelopes downstream of the supplying station.

9. A device as defined in claim 1, wherein the charging station is configured as a sheet feeder.

10. A device as defined in claim 1, wherein the charging station is preceded by a sheet cutting and folding device which produces the envelopes from a roll of paper.

11. A device as defined in claim 10, wherein an open side of the envelope is provided with an adhesive edge or an adhesive fold.

12. A device as defined in claim 1, wherein a folded envelope is formed by a draw-in device which enters into the receiving pockets to supply the receiving pockets, at the charging station, with a section of a thin sheet that can be welded together at an open side at a periphery of the conveying member for enclosing the printed products.

13. A device as defined in claim 12, wherein the draw-in device is configured to be removable from the receiving pockets after the thin sheet has been formed into an envelope and filled with the printed products.

14. A device as defined in claim 13, wherein the conveying member is provided with an ejection device that is effective at the removal station.

15. A device as defined in claim 13, wherein the removal station is configured as a conveying device that communicates with an ejection device.

16. A device as defined in claim 12, wherein the conveying member is provided with an ejection device that is effective at the removal station.

17. A device as defined in claim 16, wherein the removal station is configured as a conveying device that communicates with the ejection device.

18. A device as defined in claim 12, wherein the removal station is configured as a conveying device that communicates with an ejection device.

* * * * *